US008790225B2

(12) United States Patent
Mayes et al.

(10) Patent No.: US 8,790,225 B2
(45) Date of Patent: Jul. 29, 2014

(54) HAND THERAPY SYSTEMS FOR CONDUCTING HAND REHABILITATION EXERCISES

(76) Inventors: Zaida R. Mayes, Washington, NJ (US); Alan A. Valentine, Algonac, MI (US); Thomas G. Valentine, Shelby Township, MI (US)

( * ) Notice: Subject to any disclaimer, the term of this patent is extended or adjusted under 35 U.S.C. 154(b) by 441 days.

(21) Appl. No.: 13/077,208

(22) Filed: Mar. 31, 2011

(65) Prior Publication Data

US 2011/0245041 A1 Oct. 6, 2011

Related U.S. Application Data

(60) Provisional application No. 61/319,768, filed on Mar. 31, 2010.

(51) Int. Cl.
*A63B 21/00* (2006.01)

(52) U.S. Cl.
USPC ..... 482/127; 482/148; 482/45; 482/46; 482/80

(58) Field of Classification Search
USPC ..... 482/127, 148, 45, 46, 80, 55, 79
See application file for complete search history.

(56) References Cited

U.S. PATENT DOCUMENTS 4,863,203 A * 9/1989 Mitchell, Jr. ..... 285/373
6,676,570 B2 * 1/2004 Valentino ..... 482/45
7,625,318 B1 * 12/2009 Heyn ..... 482/62

* cited by examiner

*Primary Examiner* — Jerome W Donnelly
(74) *Attorney, Agent, or Firm* — Doherty IP Law Group LLC

(57) ABSTRACT

A hand therapy system including a post having an upper end and a lower end, a support base secured to the lower end of the post for supporting the post atop a surface, and a hand exercise housing mounted on the post for moving between the upper and lower ends of the post. The hand exercise housing includes a plurality of first hand tool openings provided on a first side of the hand exercise housing, a plurality of second hand tool openings provided on a second side of the hand exercise housing, a progressive resistance system in communication with each of the first and second hand tool openings, and a plurality of resistance level adjustment elements coupled with the progressive resistance system. Each of the resistance level adjustment elements is associated with one of the first and second hand tool openings for selectively adjusting the resistance level of each of the first and second hand tool openings.

20 Claims, 17 Drawing Sheets

HAND THERAPY SYSTEMS FOR CONDUCTING HAND REHABILITATION EXERCISES

CROSS REFERENCE TO RELATED APPLICATIONS

The present application claims the benefit of U.S. Provisional Application Ser. No. 61/319,768, filed Mar. 31, 2010, the disclosure of which is hereby incorporated by reference herein.

BACKGROUND OF THE INVENTION

1. Field of the Invention

The present invention generally relates rehabilitation devices, and more specifically relates to systems and devices for conducting hand therapy exercises.

2. Description of the Related Art

Physical and occupational therapies are used to treat patients suffering from hand injuries or reduced hand function. These therapies typically generally seek to restore some level of hand movement and function. In order to attain results, physical therapists and occupational therapists often use hand exercisers and devices, therapies, and repetitive motion exercises to re-train muscles and joints so as to regain strength and movement in the hand.

Both fine and gross motor skills are required to perform daily activities. Fine motor skills are used for activities such as brushing teeth, getting dressed, serving a cup of coffee, or eating. Proper functioning of the upper extremities and the hand is essential for utilizing fine motor skills. Gross motor skills are used during activities such as getting out of bed, crawling, walking, the ability to maintain and recover balance, and protecting the body when falling. Upper extremity function has an important role in many of these and other everyday activities.

Upper extremity control is required for both fine and gross motor skills. The recovery of upper extremity function is an important aspect of retraining motor control and falls within the scope of most areas of rehabilitation, including both occupational and physical therapy. Normal upper extremity function includes the ability to reach for, grasp, and manipulate objects. It is also the basis for fine motor skills required for daily functional activities such a feeding, dressing, grooming, and handwriting, which are all necessary for living independently.

Of all of the parts in a human body, the human hand has the most intricate and complex system of muscles, nerves and joints. After musculoskeletal or neuromuscular illness, any damage or direct trauma to the hand may result in injuries that require lengthy and arduous rehabilitation. Immobilization due to broken bones, torn tendons, or disuse after neurological trauma may lead to poor flexibility, weakness and atrophy of the hand.

Building up of the strength and flexibility of the individual fingers of the hand and distal upper extremity and hand function is a complex task that can be problematic, due to the high number of variations that are required to achieve maximum strength and a total return to usefulness and normal function.

For many years, conventional medicine taught that body function was localized to various parts of the central nervous system, that the adult central nervous system was rigid and unalterable, and that regeneration and reorganization of the central nervous system after injury was impossible. This view of the central nervous system resulted in therapies being directed at compensation since recovery of function was not possible. More recent research in the field of neuroscience has shown that the adult central nervous system has great plasticity and capacity of regeneration and reorganization following central as well as peripheral lesion.

As demonstrated by research, repetitive movement typically leads to procedural learning during motor skill acquisition. The theory of motor learning emphasizes automation of a desired movement. It is now known that the more time spent practicing movements as accurately as possible, the better the learning, so that the repetitive movement becomes an automatic motor activity.

There have been a number of efforts directed to rehabilitating hand function. For example, BTE Technologies of Hanover, Md. provides a rehabilitation system sold under the name Simulator II. The Simulator II provides hand therapy, general orthopedic and neurological rehabilitation capabilities for injured workers. The Simulator II includes a central processing unit that operates the system and track patient performance. Unfortunately, the Simulator II is expensive and immobile, and requires a skilled technician to operate the system. Moreover, the system may not be taken home by a patient for conducting hand rehabilitation exercises at home.

U.S. Pat. No. 6,676,570 to Valentino discloses a rehabilitation device having an elongated, angular body with a first end and a second end, whereby the first end has a first chuck and a second end has a second chuck. The first and second chucks are adapted to hold turning knobs. The rehabilitation device includes a tripod upon which the body is mountable. The device also includes different gears so that a range of resistance levels is available. A variety of different styles of turning knobs may be used with the device in order to provide a range of grasping and seizing actions made by the hand. Although the Valentino device is mobile so that it may be taken home by a patient, it still lacks versatility because it doesn't provide a wide range of tool positioning slots for use by the patient. Each time the patient seeks to change the height of a tool, the patient must re-adjust a tripod structure, which can be complex and discourage use of the device.

In view of the above deficiencies, there remains a need for smaller and less expensive rehabilitation devices that may be easily used by therapists and patients. There is also a need for rehabilitation devices that offer both patients and therapists diverse therapeutic alternatives to retrain wrist, hand and finger movements mimicking functions that can be easily transferred to a task oriented approach thereby maximizing therapeutic effect. There also remains a need for rehabilitation devices that are universally applicable to many injuries, as well as to patients having different sizes and shapes. In addition, there remains a need for hand therapy systems usable for rehabilitation of orthopedic and musculoskeletal injuries, neuromuscular impairments, traumatic brain injuries, stroke, muscular dystrophies, spinal cord injuries, and other debilitating diseases that impair hand movement and function. In addition, there is also a need for hand therapy manipulation devices that provide therapists with the ability to retrain patients in movements such as wrist flexion, extension, supination, pronation, abduction, adduction and circumduction, finger flexion, extension, abduction, adduction, grasp, grip and pinch, as well as gradually strengthening the muscular systems involved in such movements.

SUMMARY OF THE INVENTION

In one embodiment, a hand therapy system for conducting hand therapy exercises preferably includes a post having an upper end and a lower end, and a base secured to the lower end of the post for supporting the post atop a surface. In one embodiment, the post is desirably a vertically-extending post and the support base may include suction cups for holding the base in place atop a surface such as a table or the floor.

In one embodiment, the hand therapy system preferably includes a hand exercise housing that is mounted on the post and that is adapted for moving between the upper and lower ends of the post. In one embodiment, the hand exercise housing preferably includes a plurality of first hand tool openings provided on a first side of the hand exercise housing, and a plurality of second hand tool openings provided on a second side of the hand exercise housing. The hand exercise housing desirably includes a progressive resistance system that is in communication with each of the first and second hand tool openings. The progressive resistance system is preferably adapted to apply increasing levels of compression force upon rotatable hand tools inserted in the first and second hand tool openings for increasing resistance levels. In one embodiment, the hand exercise housing preferably includes a plurality of resistance level adjustment elements coupled with the progressive resistance system. Each of the resistance level adjustment elements is desirably associated with one of the first and second hand tool openings for selectively adjusting the resistance level of each of the first and second hand tool openings.

In one embodiment, the hand exercise housing is adapted to slide between the upper and lower ends of the post for adjusting the vertical height of the hand exercise housing on the post. For example, in one embodiment, the hand exercise housing may be positioned closer to the lower end of the post so that hand exercises may be conducted while a patient is seated. In another embodiment, the hand exercise housing may be positioned closer to the upper end of the post so that hand exercises may be conducted while the patient is standing. In one embodiment, the system preferably includes at least one locking element coupled with the hand exercise housing that is adapted to engage the post for locking the hand exercise housing on the post. The at least one locking element may include a rotatable locking knob having a threaded shaft that has a distal end adapted to contact the post for locking the hand exercise housing in place on the post. In one embodiment, the rotatable locking knob may be rotated in a counter-clockwise direction for enabling the hand exercise housing to be slid up and down the post to a desired location. Once the desired location on the post is reached, the rotatable locking knob may be tightened for locking the position of the hand exercise housing on the post.

In one embodiment, the progressive resistance system preferably includes a plurality of size-adjustable openings whereby each of the size-adjustable openings is in communication with one of the first and second hand tool openings provided on the hand exercise housing. In one embodiment, each of the size-adjustable openings is coupled with or in communication with one of the resistance level adjustment elements. The resistance level adjustment elements are preferably operable for changing the diameter of each of the size-adjustable openings so as to change resistance levels applied to hand tools inserted into the first and second hand tool openings.

In one embodiment, the hand exercise housing desirably includes resistance level indicia provided thereon. The resistance level indicia are preferably associated with each of the resistance level adjustment elements so that operators may select preferred resistance levels. In one embodiment, the resistance level adjustment elements are rotatable knobs. In one embodiment, a first hand tool may be set to a first resistance level and a second hand tool may be set to a second resistance level that is different than the first resistance level. As a result, a patient may engage in bilateral hand therapy exercises, whereby each hand confronts a different resistant level.

In one embodiment, the hand therapy system preferably includes a plurality of hand tools that are insertable into the first and second hand tool openings. The plurality of hand tools may be storable within a tool carrying case. In one embodiment, at least one of the hand tools includes an elongated shaft that is insertable into one of the first and second tool openings and the size-adjustable opening of the progressive resistance system associated therewith. In one embodiment, the elongated shaft has one or more longitudinally extending slots formed therein that facilitate radial compression of the elongated shaft. As the diameter of one of the size-adjustable openings is reduced, the size-adjustable opening preferably compresses the elongated shaft radially inwardly for increasing the resistance level applied to the elongated shaft.

In one embodiment, the plurality of hand tools may include rotatable hand tools such as finger wheels, finger wheels with pins, hand wheels, star knobs, door knobs, finger knobs, finger butterflies, thumb screws, door handles, eye bolts, and/or wrist bars. In one embodiment, each of the hand tools desirably includes an elongated shaft that is insertable into one of the first and second hand tool openings and that is rotatable about the elongated shaft during hand therapy exercises.

In one embodiment, the hand exercise housing preferably has a central opening extending from an upper end to a lower end thereof. In one embodiment, the post preferably passes through the central opening for mounting the hand exercise housing on the post. The hand exercise housing may include one or more flexible gaskets that project into the central opening of the hand exercise housing for engaging the post so as to stabilize the hand exercise housing on the post. The one or more flexible gaskets preferably enable sliding movement of the hand exercise housing along the post while minimizing any gaps or spaces that may exist between the hand exercise housing and the outer surface of the post.

In one embodiment, the first hand tool openings are spaced apart from one another on the first side of the hand exercise housing at different vertical and horizontal positions, and the second hand tool openings are spaced apart from one another on the second side of the hand exercise housing at different vertical and horizontal positions. The hand tool openings may be spaced in an array. As a result, patients may insert a first hand tool into the first side of the hand exercise housing and a second hand tool into the second side of the hand exercise housing for conducting bilateral hand therapy exercises. Moreover, patients may easily remove a hand tool from one of the first hand tool openings and insert it into another one of the first hand tool openings at a different vertical or horizontal position. The same action may be conducted on the second side of the hand exercise housing. The plurality of hand tool openings on both sides of the hand exercise housing provides a greater range of possible positions for the hand tools and a greater range of hand therapy exercises that may be conducted without requiring major adjustments to the system, as is required when using prior art devices. Moreover, a patient may readily change the vertical height position of a hand tool without making complex adjustments to the post and the support base for the post, as is required in prior art devices.

In one embodiment, a first rotatable hand tool is inserted into one of the first hand tool openings and a second rotatable hand tool is inserted into one of the second hand tool openings for enabling bilateral hand therapy. The resistance levels applied to the first and second hand tools may be adjusted using the resistance level adjustment elements associated with the hand tools. In one embodiment, the resistance level of one of the hand tools may be different than the resistance level of the other hand tool. As the hand therapy exercise becomes easier for a patient, the patient may adjust the resistance level for making the hand therapy exercises more challenging.

These and other preferred embodiments of the present invention will be described in more detail herein.

DETAILED DESCRIPTION

Figure 1:
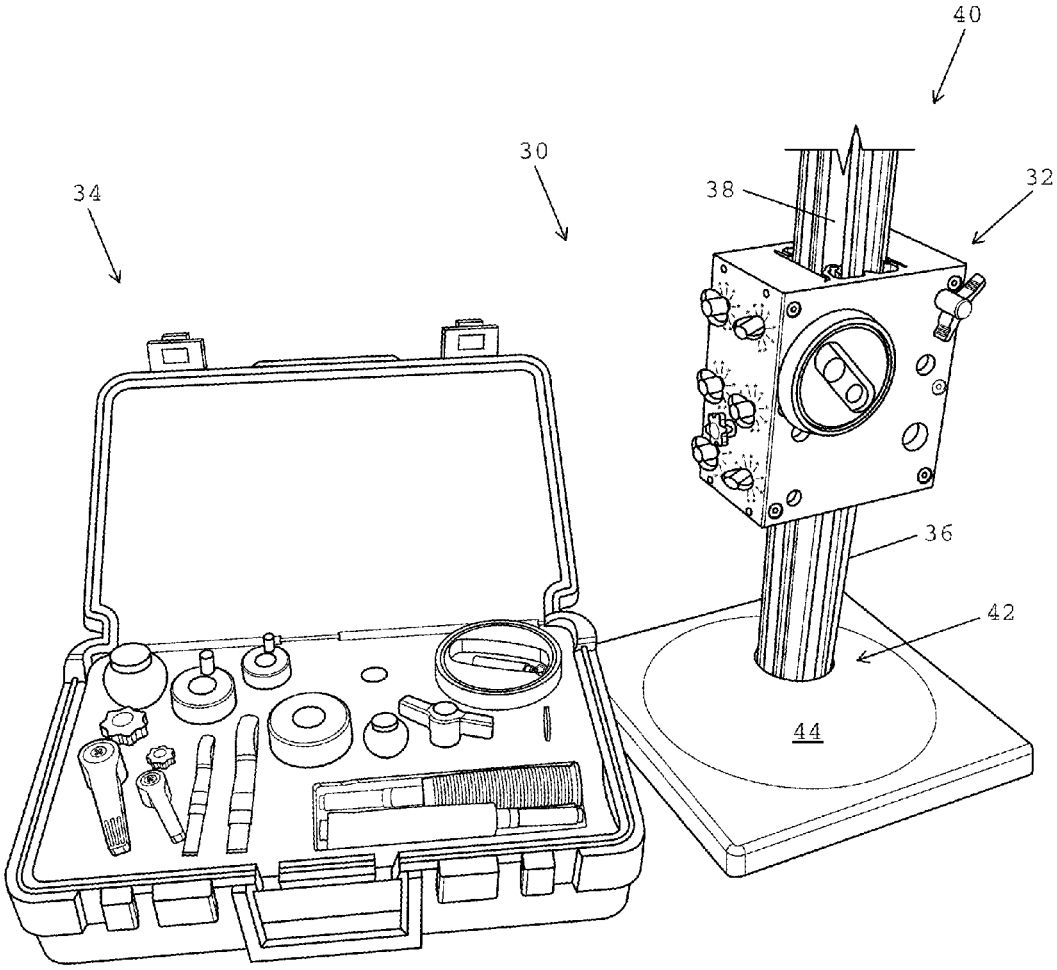
FIG. 1 shows a perspective of a hand therapy system including a hand exercise tower and a tool carrying case for hand exercising tools, in accordance with one embodiment of the present invention.

Referring to FIG. 1, in one embodiment, a hand therapy system 30 includes a hand exercise tower 32 and a tool carrying case 34 containing a plurality of hand exercise tools used for conducting hand therapy exercises. In one embodiment, the hand exercise tower 32 preferably includes a vertically-extending post 36 having vertically-extending grooves 38 formed therein. The vertically-extending post 36 desirably includes an upper end 40 and a lower end 42. The hand exercise tower 32 preferably includes a support base 44 that is secured to the lower end 42 of the vertically-extending post 36 for supporting the post 36 in an upright position. In one embodiment, an underside of the support base 44 may include one or more suction cups (not shown) for securely holding the support base 44 to a flat surface such as a table or to the floor. In one embodiment, the hand exercise tower 32 preferably includes a hand exercise housing 46 that is mounted on the vertically extending post 36 and that may be positioned at different heights on the post.

Figure 2:
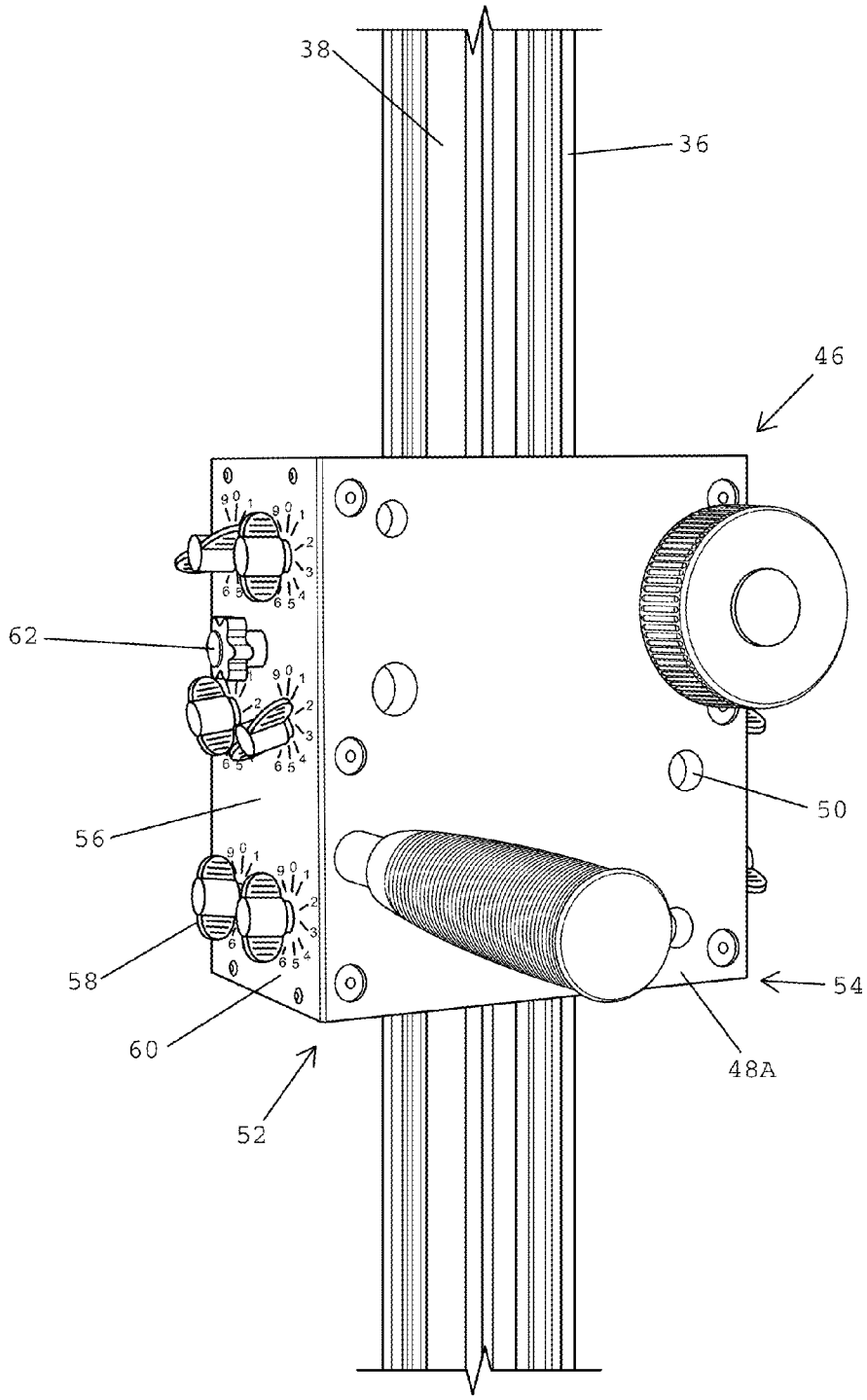
FIG. 2 shows a side view of the hand exercise tower of FIG. 1 including a vertical post and a hand exercise housing mounted on the vertical post, in accordance with one embodiment of the present invention.

Referring to FIG. 2, in one embodiment, the vertical post 36 preferably includes vertically extending grooves 38 that extend along the longitudinal axis of the vertical post. The hand exercise housing 46 is mounted on the vertical post 36 and is adapted to move (e.g. slide) up and down along the vertical post. The hand exercise housing 46 preferably includes a first side plate 48A having a plurality of tool openings 50 formed therein. The plurality of tool openings 50 may have different diameters adapted for receiving the shafts of hand exercise tools, as will be described in more detail below.

In FIG. 2, the tool openings 50 include a first column of openings 52 extending along a first edge of the first side plate 48A and a second column of openings 54 extending along a second edge of the first side plate 48A. In FIG. 2, a first tool is inserted into a tool opening 50 within the first column of tool openings 52, and a second tool is inserted into a tool opening in the second column of tool openings 54.

In one embodiment, the hand exercise housing 46 includes a front face 56 including a plurality of resistance level adjustment knobs 58. In one embodiment, each of the resistance adjustment knobs 58 is associated with one of the tool openings 50. The front face 56 preferably includes indicia 60 provided thereon that is associated with each of the resistance adjustment knobs 58 for indicating varying degrees of resistance. In one embodiment, as the resistance adjustment knobs 58 are rotated in a clockwise direction, the resistance level applied to one of the hand tools inserted in tool opening 50 increases, thereby making it more difficult for an individual to rotate the hand tool.

In one embodiment, the hand exercise housing 46 preferably includes a vertical adjustment knob 62 that passes through the hand exercise housing for engaging the vertical post 36. In one embodiment, the vertical adjustment knob 62 is rotated in a counter-clockwise direction for enabling the hand exercise housing 46 to be moved up or down relative to the vertical post 36. After an operator has positioned the hand exercise housing 46 at a desired location along the vertical post 36, the vertical adjustment knob may be rotated in a clockwise direction for locking the hand exercise housing 46 in place, and preventing further movement of the housing 46 relative to the post 36.

Figure 3:
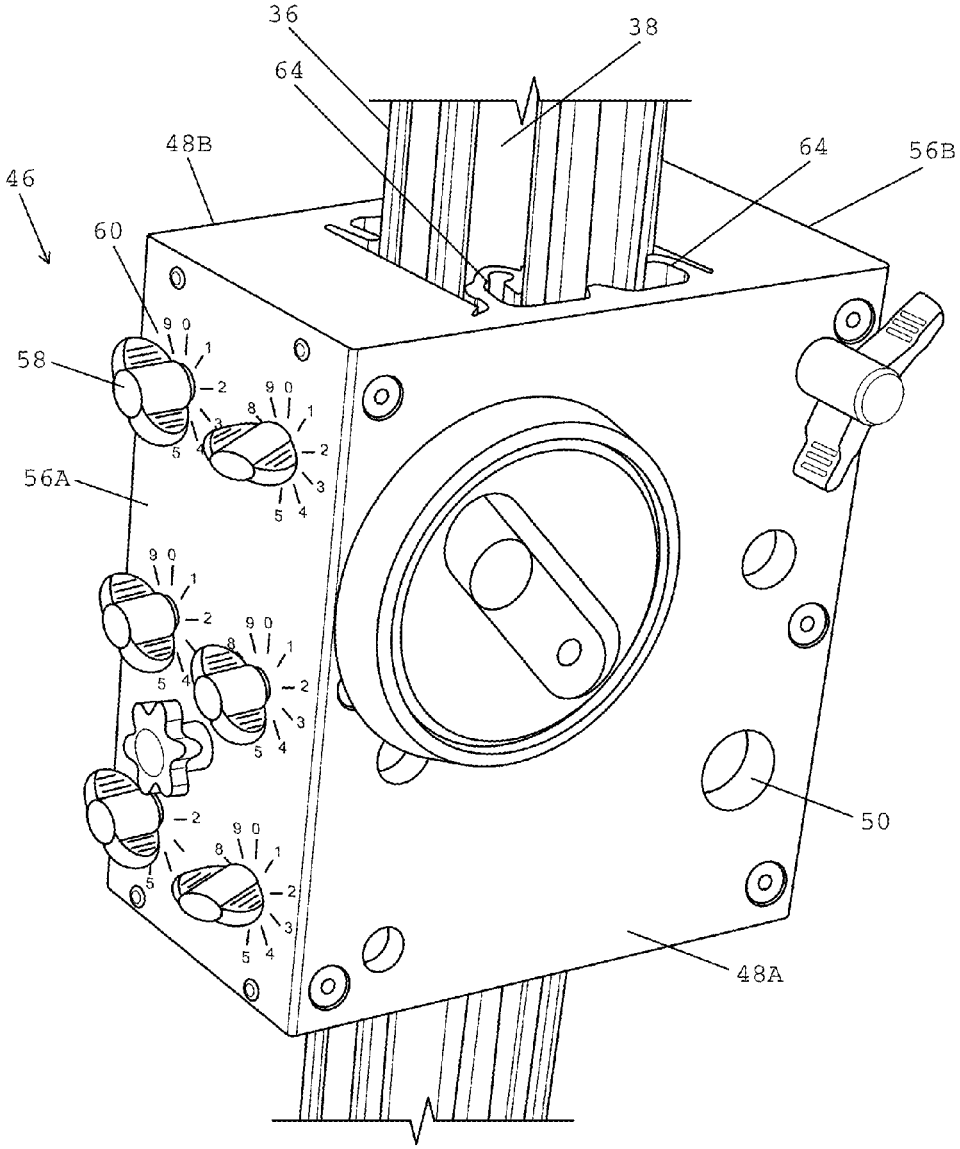
FIG. 3 shows a perspective view of the hand exercise housing of FIG. 2 including resistance level adjustment knobs and a vertical adjustment knob, in accordance with one embodiment of the present invention.

Referring to FIG. 3, in one embodiment, the hand exercise housing 46 is mounted on the vertical post 36. The hand exercise housing 46 includes the first side plate 48A having a plurality of tool openings 50 with different diameters, a second side plate 48B also having a plurality of tool openings (not shown), a first resistance level adjustment plate 56A including resistance level adjusting knobs 58, and a second resistance level adjustment plate 56B including a plurality of resistance level adjustment knobs (not shown).

As noted above, the vertical post 36 includes vertically extending grooves 38. Each of the first and second side plates 48A, 48B preferably include post securement gaskets 64 that engage grooves 38 in the vertical post 36 for guiding the hand exercise housing 46 up and down along the vertical post 36. In one embodiment, the post securement gaskets 64 are preferably flexible for providing a snug fit between the hand exercise housing and the post, while enabling sliding movement of the hand exercise housing 46 relative to the post 36.

The first resistance level adjustment face 56A of the hand exercise housing 46 includes a plurality of resistance adjustment knobs 58. Each of the resistance adjustment knobs 58 is associated with one of the tool openings 50 in the respective first and second side plates 48A, 48B. The first resistance level plate 56A includes indicia 60 associated with each resistance adjustment knob that provide an indication of the resistance level that has been attained by rotating a respective resistance level adjustment knob.

Figure 4:
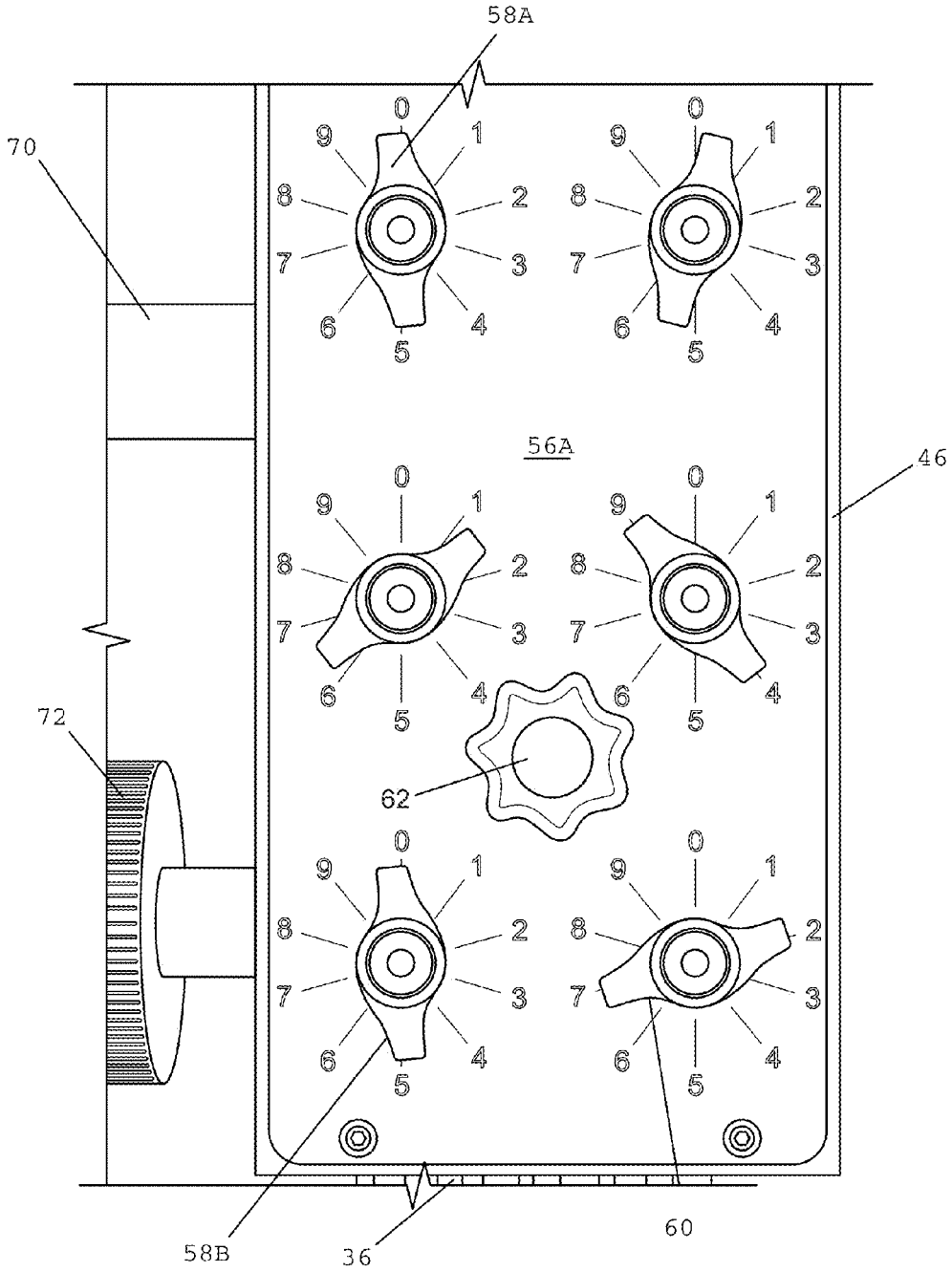
FIG. 4 shows a front face of the hand exercise housing of FIG. 3 including a plurality of resistance level adjustment knobs and a vertical adjustment knob, in accordance with one embodiment of the present invention.

Referring to FIG. 4, in one embodiment, the first resistance level adjustment plate 56A preferably includes a plurality of resistance level adjustment knobs 58 provided thereon. The first resistance level adjustment plate 56A desirably includes resistance level indicia 60 associated with each of the resistance level adjustment knobs 58. In one embodiment, the scale for the resistance level indicia 60 includes resistance level zero (0) through resistance level nine (9). In one embodiment, each of the resistance level adjustment knobs 58 is rotated in a clockwise direction for increasing the resistance level and a counter-clockwise direction for decreasing the resistance level. Higher resistance levels are preferably associated with higher forces required for rotating a tool inserted into a tool opening.

FIG. 4 shows a first hand tool 70 associated with a resistance level adjustment knob 58A. As the first resistance level adjustment knob 58A is rotated in a clockwise direction, the resistance level on the shaft of the first hand tool 70 is increased for making it more difficult for an operator to rotate the first hand tool 70. The first resistance level adjustment plate 56A includes a second resistance level adjustment knob 58B that is associated with a second hand tool 72. As above, rotation of the second resistance level adjustment knob 58B in a clockwise direction makes it more difficult for an operator to rotate the second hand tool 72. The first resistance level adjustment plate 56A also desirably includes a vertical adjustment knob 62 that may be rotated in a counter-clockwise direction for enabling the hand exercise housing 46 to moved up or down along the vertical post 36. Once a preferred location along the vertical post is attained, the hand exercise housing 46 may be locked in place by rotating the vertical adjustment knob 62 in a clockwise direction.

Figure 5:
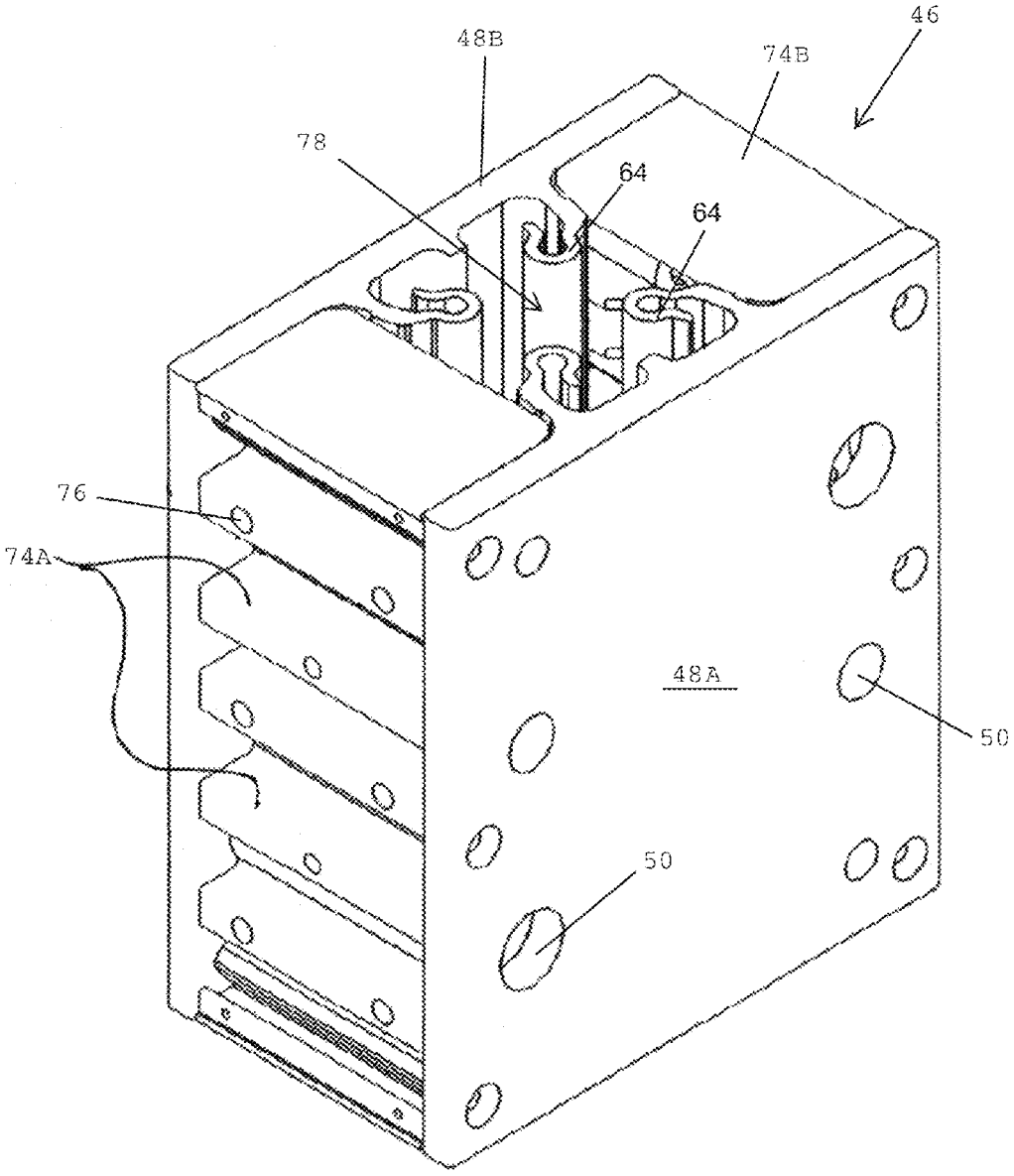
FIG. 5 shows a perspective view of a partially assembled hand exercise housing, in accordance with one embodiment of the present invention.

Referring to FIG. 5, in on embodiment, the hand exercise housing 46 preferably includes a first side plate 48A having a plurality of tool openings 50 extending therethrough. In one embodiment, the tool openings 50 preferably have different sized diameters for accommodating hand tools having different sized shafts. The hand exercising housing 46 preferably includes a second side plate 48B that is opposite the first side plate 48A. Each of the first and second side plates 48A, 48B preferably have post securement gaskets 64 that are adapted to engage the vertically extending grooves on the vertical post 36 (FIG. 3).

In one embodiment, the hand exercise housing 46 preferably includes first resistance level plate 74A that extends along the first side of the hand exercise housing and a second resistance level plate 74B that extends along a second side of the hand exercise housing.

In one embodiment, the first resistance level plate 74A includes apertures 76 that are adapted to receive shafts of the respective resistance level adjustment knobs 58 shown and described above in FIGS. 2-4. In one embodiment, each of the apertures 76 is associated with one of the tool openings 50 formed in either the first side plate 48A or the second side plate 48B.

In one embodiment, after the first and second side plates 48A, 48B and the first and second resistance level plates 74A, 74B have been assembled together, the central opening 78 extending from an upper end to a lower end of the hand exercise housing 46 is adapted to receive the vertically extending post 36 (FIG. 2).

Figure 6:
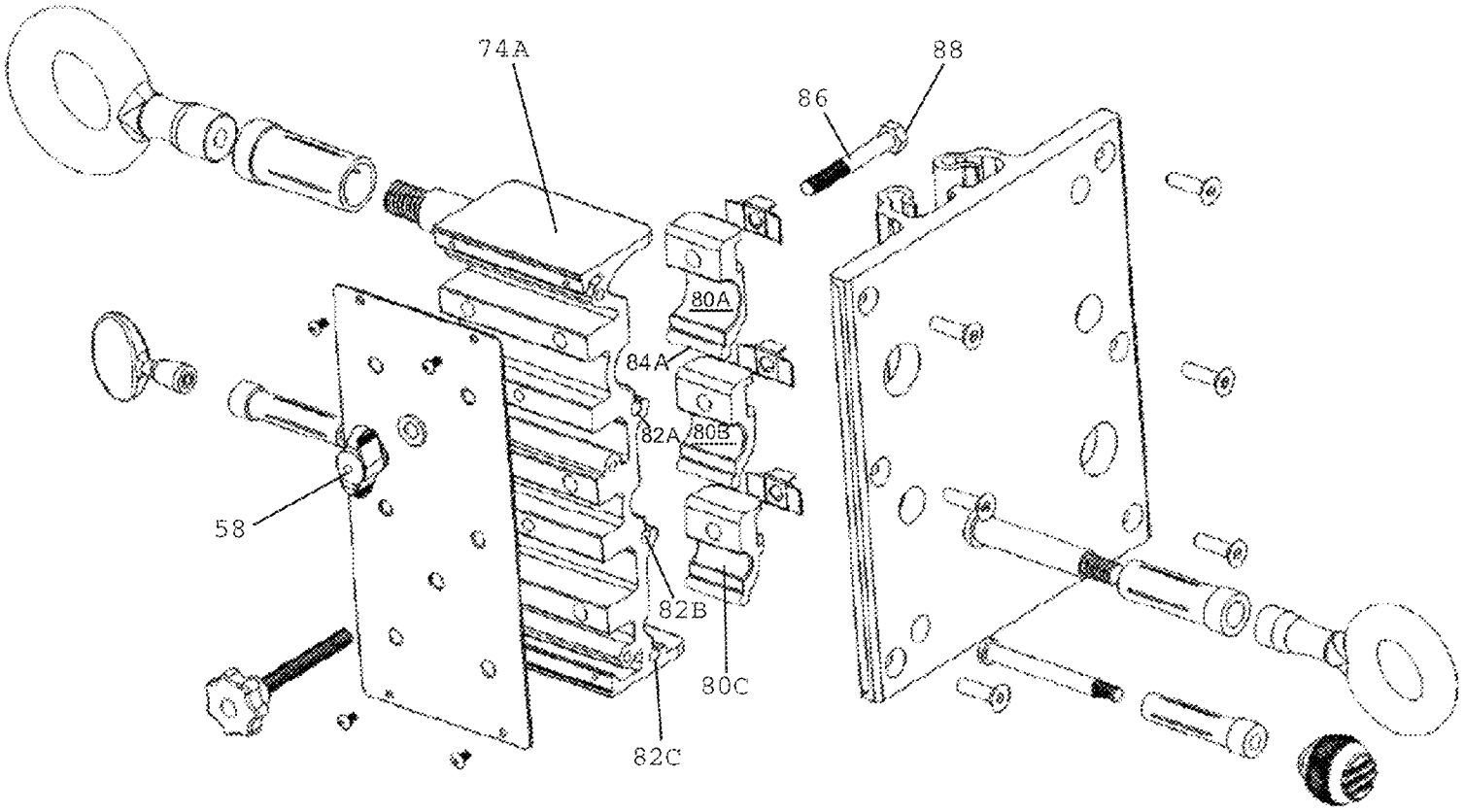
FIG. 6 shows an exploded view of a portion of a hand exercise housing, in accordance with one embodiment of the present invention.

Referring to FIG. 6, in one embodiment, the first resistance plate 74A preferably includes a series of clamps 80A-80C that are pivotally connected with the first resistance level resistance plate 74A. In one embodiment, the first resistance plate 74A includes a series of horizontally extending grooves 82A-82C that are adapted to receive pivot posts 84A-84C that are provided at lower ends of the respective clamps 80A-80C. In one embodiment, the pivot post 84A at the lower end of the first clamp 80A is inserted into the first horizontally extending groove 82A provided on the first resistance plate 74A. Once the pivot connection is made, an upper end of the first clamp 80A may pivot toward and away from the first resistance plate 74A for adjusting the size of an opening between an inner face of the first resistance plate 74A and the first clamp 80A.

In one embodiment, a threaded bolt 86 passes through openings in the first clamp 80A and the first resistance plate 74A. The threaded bolt 86 includes a head 88 at one end thereof for preventing the threaded bolt from passing all the way through the openings in the first clamp 80A and the first resistance plate 74A. The end of the threaded bolt 86 that is opposite the head 88 includes threads that are adapted to mesh with internal threads on a resistance level adjustment knob 58.

Figure 7:
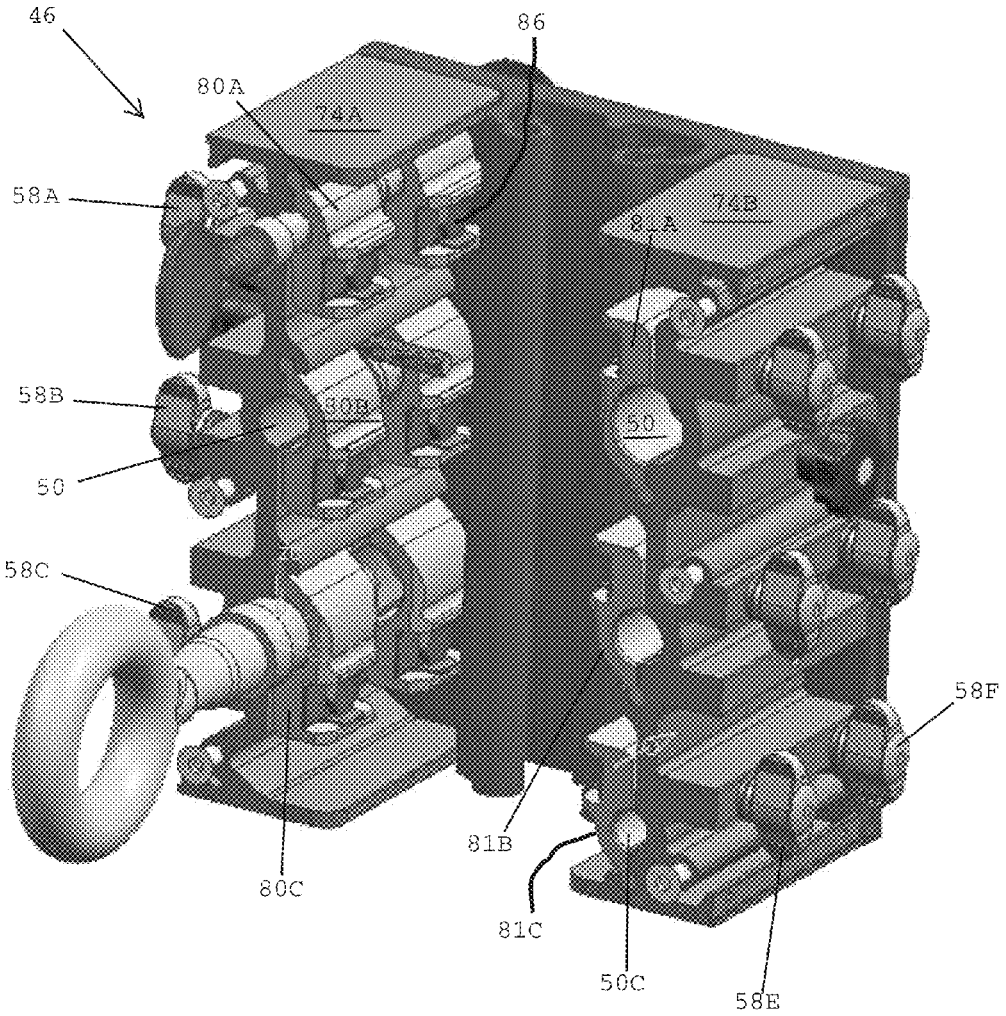
FIG. 7 shows a perspective view of a progressive resistance system incorporated into a hand exercise housing, in accordance with one embodiment of the present invention.

Referring to FIG. 7, in one embodiment, the hand exercise housing 46 includes the first resistance plate 74A and the second resistance plate 74B. The first resistance plate 74A includes a series of clamps 80A-80C pivotally secured thereto. Each of the clamps 80A-80C has a different size for defining a different sized tool opening 50 between the clamps 80A-80C and the inner face of the first resistance plate 74A. A threaded bolt 86 passes through each of the clamps 80A-80C and has a threaded end coupled with a resistance level adjustment knob 58A-58C associated therewith.

The second resistance plate 74B, which is similar to the first resistance plate, also has a series of clamps 81A-81C pivotally coupled therewith. Each of the clamps 81A-81C has a different size for defining a different diameter sized tool opening between the respective clamps and the second resistance plate 74B. Each of the second clamps 81A-81C has a front end that is pivotally connected with the second resistance plate 74B and a second end that is free to pivot toward and away from the second resistance plate. The resistance level adjustment knobs 58 may be rotated for pivoting the free ends of the respective clamps 81A-81C toward and away from the second resistance plate 74B for adjusting the size of the tool openings 50. As the size of the tool openings 50 is varied by rotating the resistance level adjusting knobs 58, the amount of force required to rotate a tool inserted into the tool openings 50 is modified.

In one embodiment, a fifth resistance level adjustment knob 58E is associated with a clamp 81C positioned on a left side of the second resistance plate 74B, and a sixth resistance level adjustment knob 58F associated with another clamp (not shown) that is pivotally coupled with the second resistance plate 74B. As a result, the resistance level exerted upon a first tool inserted into a tool opening 50C on the left side of the second resistance plate 74B may be different than the resistance exerted upon a second tool inserted into an opening on the right side of the second resistance plate 74B.

Figure 8:
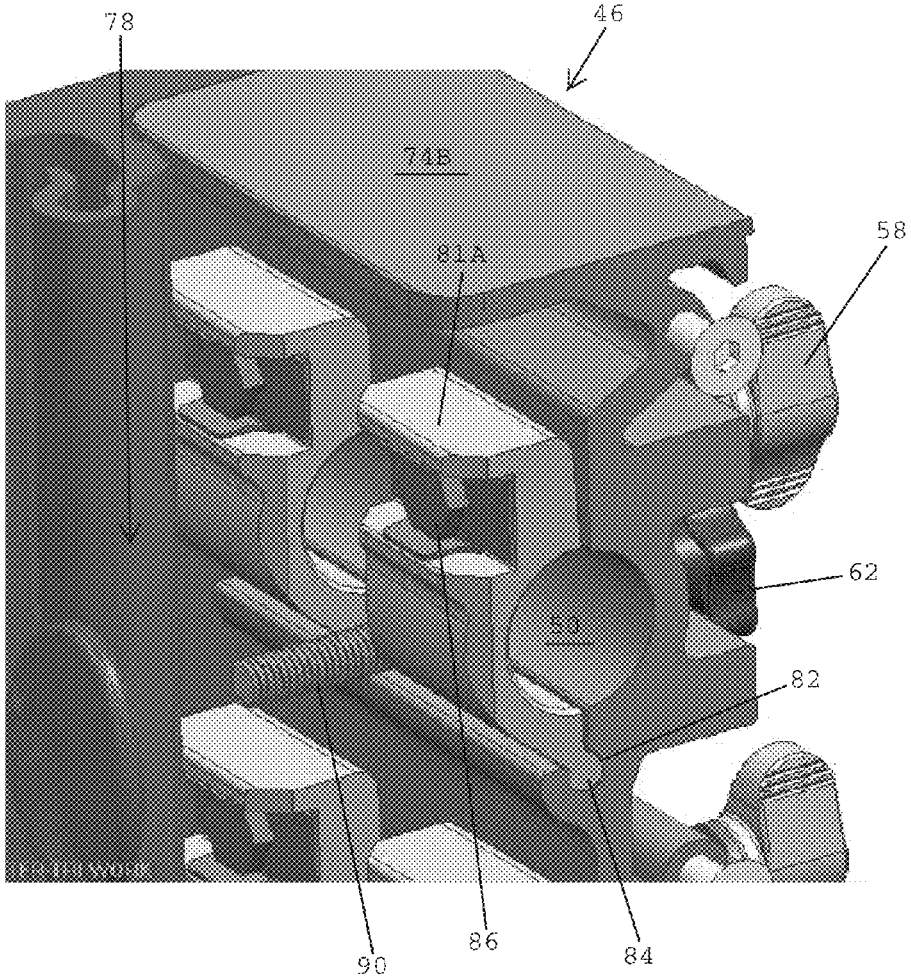
FIG. 8 shows a magnified view of a portion of the progressive resistance system shown in FIG. 7.

Referring to FIG. 8, in one embodiment, the second resistance plate 74B desirably includes a first clamp 81A pivotally coupled therewith. The second resistance plate 74B includes an elongated groove 82 formed therein that extends in a horizontal direction. The lower end of the first clamp 81A includes an elongated pivot post 84 that is seated within the elongated groove 82. The resistance level adjustment system includes a threaded bolt 86 that passes through aligned openings formed in the first clamp 81A and the second resistance plate 74B. As the resistance level adjustment knob 58 is rotated in a counter-clockwise direction, the upper end of the first clamp 81A moves away from the inner face of the second resistance plate 74B for increasing the size of the tool opening 50. As the resistance level adjustment knob 58 is rotated in a clockwise direction, the upper end of the clamp 51A moves toward the inner face of the second resistance plate 74B for reducing the size of the tool opening 50.

Referring to FIG. 8, in one embodiment, the vertical adjustment knob 62 preferably includes a threaded shaft 90 that extends through an opening in the second resistance plate 74B. The threaded shaft 90 preferably extends into the central opening 78 of the hand exercise housing 46 for engaging the vertical post 36 (FIG. 2). The vertical adjustment knob 62 is desirably rotated in a counter-clockwise direction for retracting the threaded shaft 90 so that the vertical height of the hand exercise housing may be adjusted relative to the post. Once a desired height is attained, the vertical adjustment knob 62 may be rotated in a clockwise direction for locking the hand exercise housing 46 in place at a desired height on the post.

Figure 9:
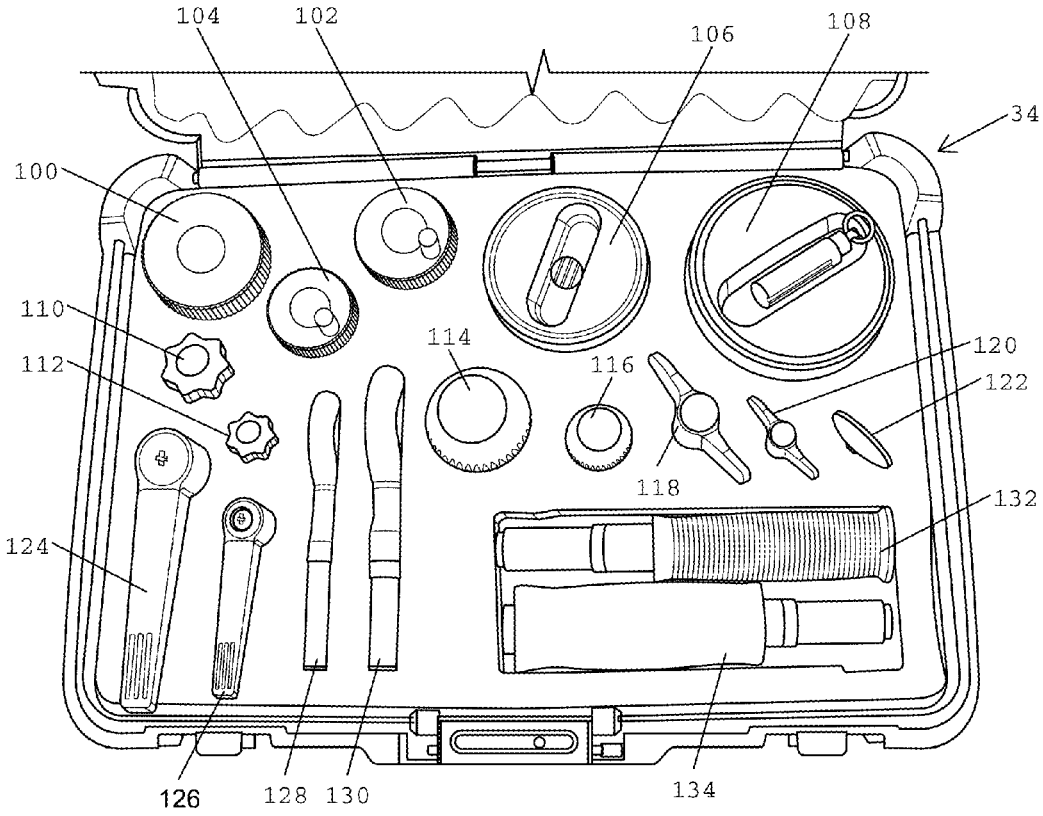
FIG. 9 shows a top perspective view of the tool case shown in FIG. 1 including a plurality of hand exercising tools, in accordance with one embodiment of the present invention.

Referring to FIG. 9, in one embodiment, the tool carrying case 34 preferably includes a plurality of hand therapy tools having shafts that are insertable into the tool openings 50 provided in the first and second side plates 48A, 48B of the hand exercise housing 46 (FIG. 5). In one embodiment, the plurality of tools include a finger wheel 100, a large finger wheel with pin 102, a small finger wheel with pin 104, a small hand wheel 106, a large hand wheel 108, a large star knob 110, and a small star knob 112. The plurality of tools may also include a large door knob 114, a small door knob 116, a large butterfly tool 118, a small butterfly tool 120 and a thumb screw 122. The plurality of tools may also preferably include a large door handle 124, a small door handle 126, a small eyebolt 128, a large eyebolt 130, a first wrist bar 132, and a second wrist bar 134 having a cushioned handle.

Figure 10:
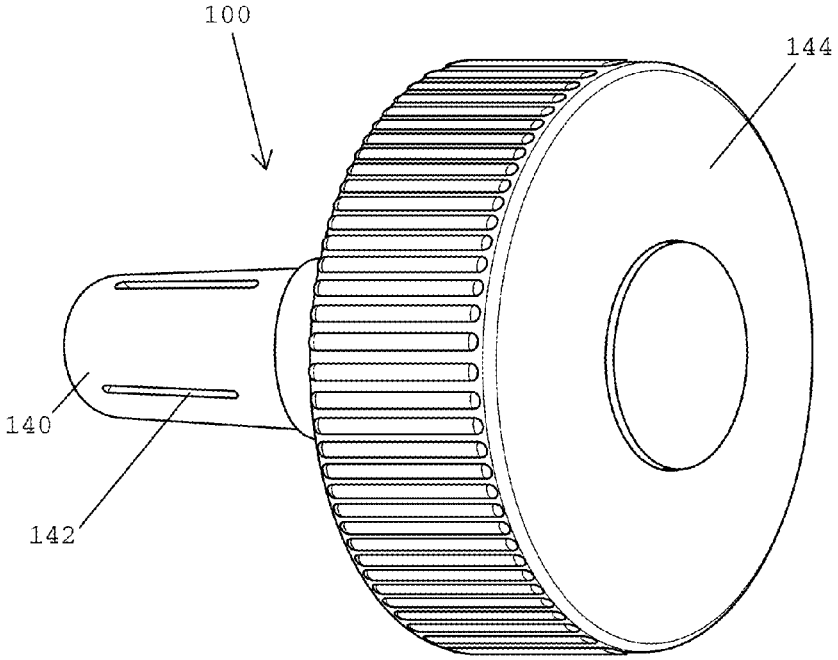
FIG. 10 shows a finger wheel tool, in accordance with one embodiment of the present invention.

Referring to FIG. 10, in one embodiment, the finger wheel tool 100 preferably includes an elongated shaft 140 that is insertable into one of the tool openings 50 (FIG. 5). The elongated shaft 140 preferably includes longitudinally extending slots 142 that enable the shaft to be compressed inwardly as the resistance level applied to the shaft 140 is adjusted. The finger wheel 100 desirably includes a wheel 144 secured to a proximal end of the shaft 140. An operator may grasp the wheel 144 for rotating the shaft 140 about its longitudinal axis.

Figure 11:
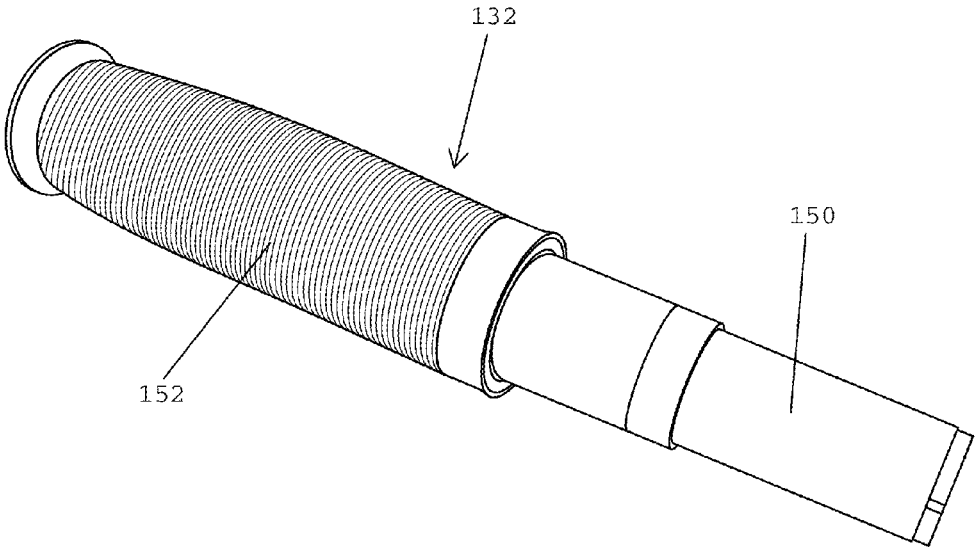
FIG. 11 shows a wrist bar tool, in accordance with one embodiment of the present invention.

Referring to FIG. 11, in one embodiment, the first wrist bar tool 132 preferably includes an elongated shaft 150 that is insertable into one of the tool openings in the hand exercise housing. A proximal end of the wrist bar 132 desirably includes a rubber handle 152 that may be grabbed by an operator. An operator preferably rotates the first wrist bar 132 about the longitudinal axis of the elongated shaft 150 for performing therapeutic exercises. The first wrist bar tool 132 is preferably used to improve cylindrical grip, wrist flexion, extension, pronation and supination. The muscles that are activated when using the tool may include the flexor carpi radialis, flexor carpi ulnaris, flexor digitorum superficialis and profundus, extensor carpi, pronator teres, supinator and biceps, brachioradialis, and the extensor digitorum.

Figure 12:
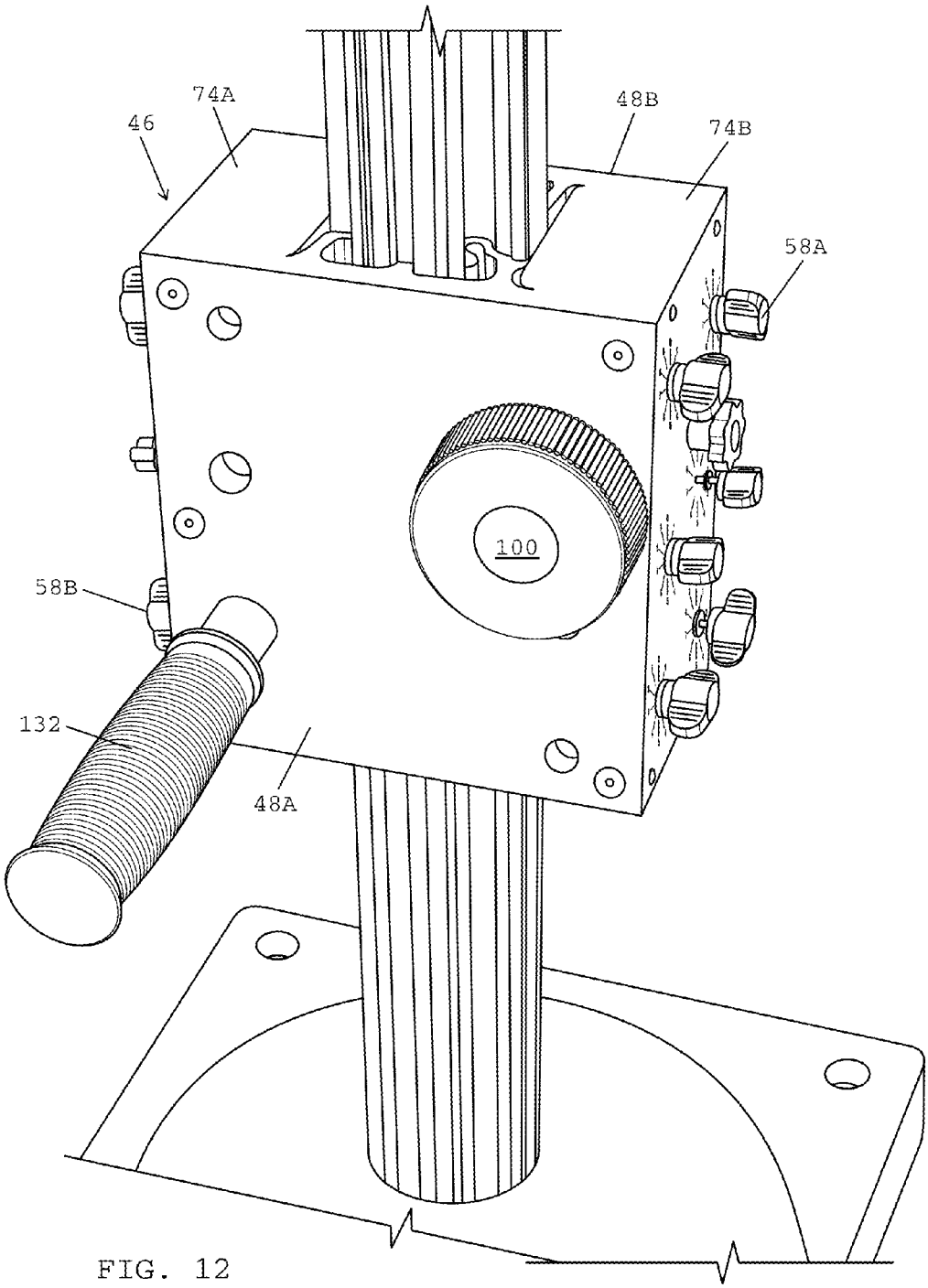
FIG. 12 shows the finger wheel and the wrist bar tools of FIGS. 10 and 11 secured to a side plate of a hand exercise housing, in accordance with one embodiment of the present invention.

Referring to FIG. 12, in one embodiment, the elongated shaft (not shown) of the finger wheel tool 100 is inserted into one of the tool openings in the first side plate 48A of the hand exercise housing 46. A first resistance level adjustment knob 58A associated with the second resistance plate 74B may be rotated for adjusting the resistance level applied to the elongated shaft of the finger wheel tool 100. An operator may rotate the finger wheel 100 in either a counter-clockwise or clockwise direction for engaging in hand therapy activities. In one embodiment, the finger wheel tool 100 is more difficult to rotate as the first resistance level adjustment knob 58A is rotated in a clockwise direction.

As shown in FIG. 12, the first wrist bar tool 132 shown and described above in FIG. 11 is insertable into another tool opening in the first side plate 48A. A second resistance level adjustment knob 58B associated with the first resistance plate 74A is preferably rotated for adjusting the resistance level applied to the first wrist bar tool 132. An operator may rotate the first wrist bar tool 132 in either a clockwise or counter-clockwise direction for engaging in hand therapy exercises. The resistance level applied to the first wrist bar tool may be modified to make the hand therapy exercises more or less challenging.

In one embodiment, the hand exercise housing 46 has tool openings provided in both the first side plate 48A and the second side plate 48B. As a result, a first hand tool may be positioned within a tool opening extending through the first side plate 48A and a second hand tool maybe inserted through a tool opening formed in the second side plate 48B. An operator may thus perform bilateral hand exercises using both the left hand and the right hand at the same time. In addition, the resistance levels applied to the tools manipulated by the operator's respective left and right hands may be different so that a left hand may be exercised at a first resistance level and a right hand may be exercised at a second resistance level that is different than the first resistance level.

Figure 13A:
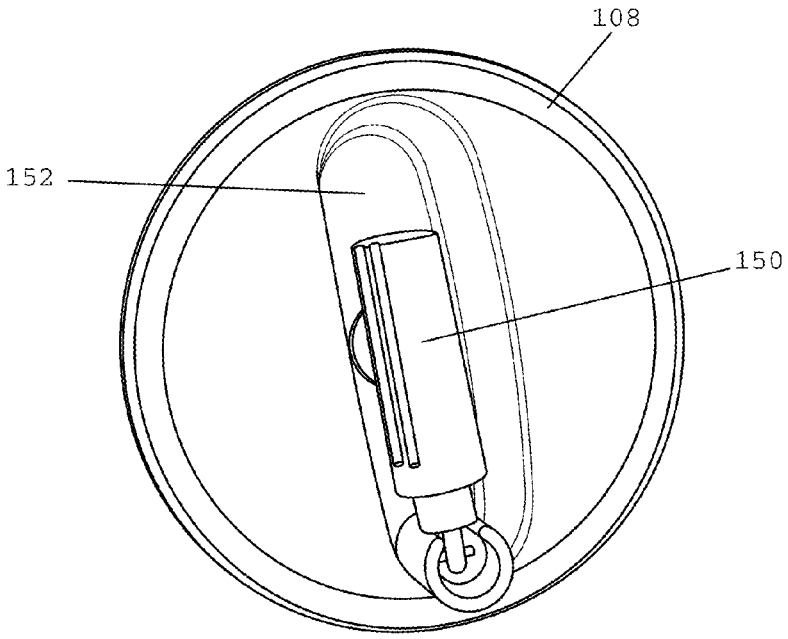
FIG. 13A shows a large hand wheel tool having an extendible pin, in accordance with one embodiment of the present invention.
Figure 13B:
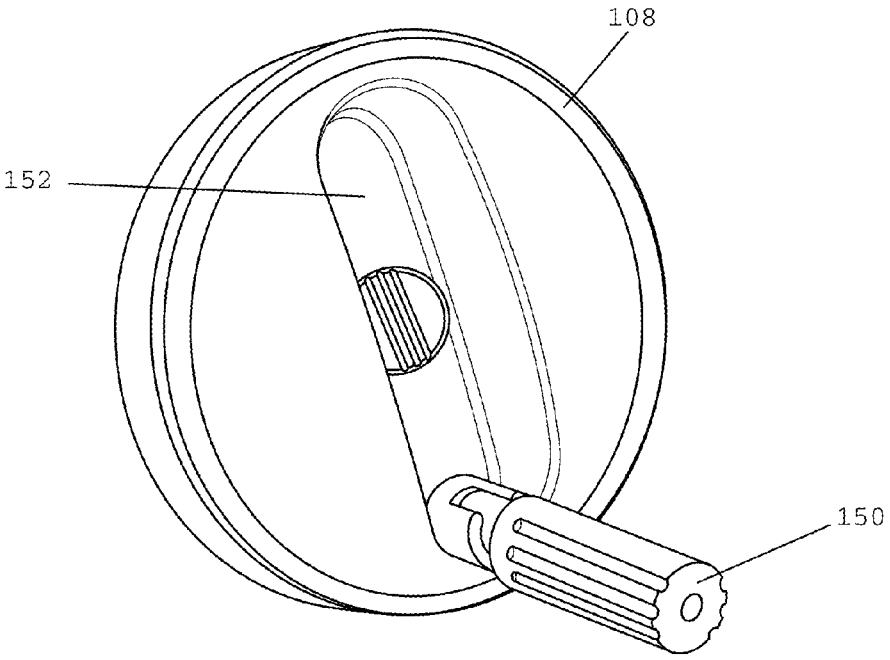
FIG. 13B shows the large hand wheel tool of FIG. 13A with the pin in an extended position.

Referring to FIG. 13A, in one embodiment, the large hand wheel tool 108 preferably includes a pin 140 that is pivotally secured to the large hand wheel tool. In one embodiment, the large hand wheel tool 108 includes a recess 142 formed therein that is adapted to seat the pivotable pin 140. In FIG. 13A, the pin 140 is seated within the recess 142. In FIG. 13B, the pin 140 is pivoted out of the recess 142 for being grasped by an operator. Although not shown in FIGS. 13A and 13B, the large hand wheel tool 108 preferably includes an elongated shaft that is insertable into one of the tool openings formed in the first and second side plates of the hand exercise housing. The large hand wheel tool 108 preferably improves pulp tip grip, tripod grip with ulnar deviation, radial deviation, and circumduction to facilitate the patient's ability to open and close jars, pill containers, using a hammer and writing. The muscles being rehabilitated when using the large hand wheel tool may include the extensor carpi ulnaris, extensor carpi radialis, flexor digitorum profundus, flexor digitorum superficialis, interoseus, lumbricales, flexor pollicis longus, flexor pollicis brevis, opponent pollicis, extensor pollicis brevis, pronator teres, supinator and biceps, brachioradialis.

Figure 14:
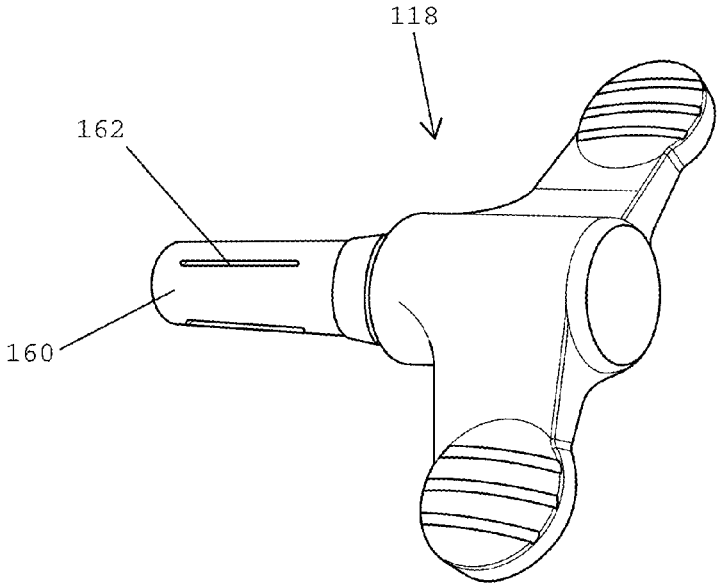
FIG. 14 shows a butterfly tool, in accordance with one embodiment of the present invention.

Referring to FIG. 14, the large butterfly tool 118 preferably has an elongated shaft 160 that is insertable into a tool opening 50 (FIG. 5). The elongated shaft includes longitudinally extending slots 162 that enable the shaft 160 to be compressed inwardly as resistance is applied to the shaft 162. The large butterfly tool 118 may be used to rehabilitate a patient to teach them a twisting motion, and provide digit flexion and finger push-ups.

Figure 15:
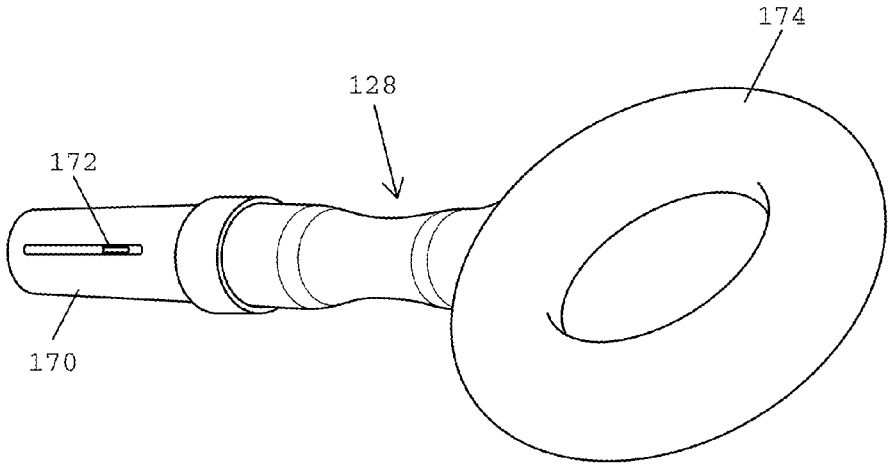
FIG. 15 shows an eye bolt tool, in accordance with one embodiment of the present invention.

FIG. 15 shows the small eyebolt tool 128 including an elongated shaft 170 insertable into a tool opening. The elongated shaft 170 preferably includes one or more longitudinally extending slits 172 formed therein that enable the shaft to be compressed inwardly as more resistance is applied to the shaft. The proximal end of the small eye bolt tool 128 includes an eyelet 174 that is grasped by an operator during hand therapy exercises. In one embodiment, the small eyebolt tool 128 may be turned by a patient's hand in order to simulate the action which is necessary for key pinch, latch pinch, palmar grip, side opposition and also to create digit flexion and extension, and finger push-ups. The use of the small eyebolt tool will desirably improve a patients' ability to open and close fingers and improve digit strength for activities like typing, pushing buttons in a calculator, to use the telephone and ATM, or any activity requiring individual finger pushing strength. The muscles that may be activated include the abductor pollicis brevis and longus, flexor pollicis longus, flexor pollicis brevis, extensor pollicis longus, extensor pollicis brevis, intrinsics, interoseus, extensor difitorum, flexor digitorum, superficialis and the profundus.

Figure 16:
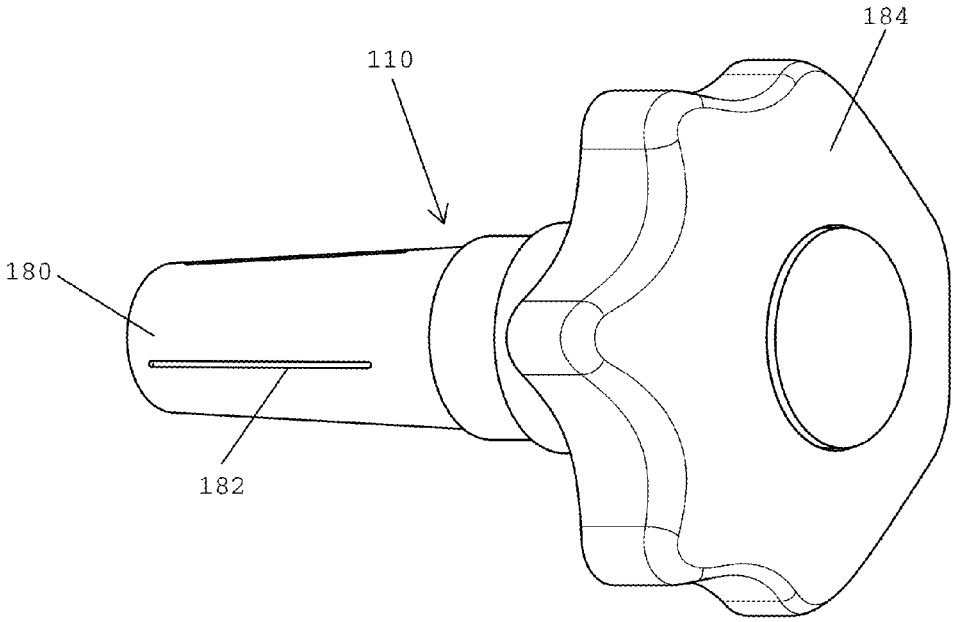
FIG. 16 shows a star knob tool, in accordance with one embodiment of the present invention.

FIG. 16 shows a large star wheel tool 110 including an elongated shaft 180 insertable into a tool opening. The elongated shaft 180 desirably includes one or more slits 182 that extend along the longitudinal axis of the elongated shaft 180. The elongated shaft 180 is preferably insertable into a tool opening for performing hand therapy exercises. A star wheel handle 184 adapted to be grasped by an operator is secured to a proximal end of the elongated shaft 180. The large star wheel tool 110 may be used to rehabilitate a patient in the manner of training his or her pincer grip, which facilitates and strengthens finger grip and thumb opposition, and which helps to rehabilitate a patient's ability for screwing and unscrewing cylindrical caps.

Figure 17:
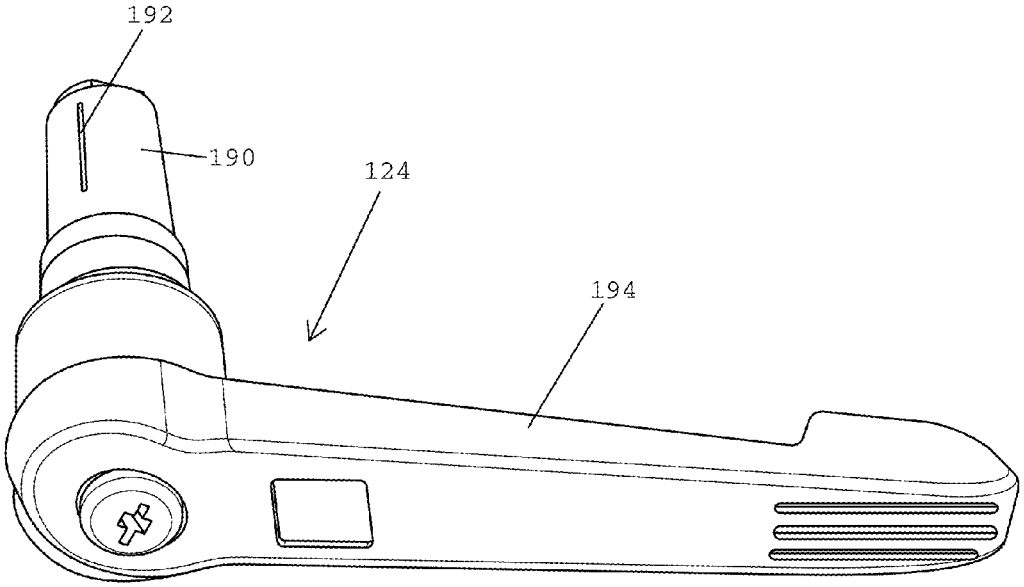
FIG. 17 shows a door handle tool, in accordance with one embodiment of the present invention.

Referring to FIG. 17, in one embodiment, a large door handle tool 124 preferably includes an elongated shaft 190 insertable into a tool opening. The elongated shaft 190 desirably includes an elongated slit 182 that enables the shaft to be compressed inwardly. The large door handle tool 124 preferably includes a handle portion 194 that is grasped by an operator. The large door handle device 124 desirably enables patients to exercise their hands in order to be able to open bathroom doors and French door handles as will be found in many bathroom fixtures. In one embodiment, the patient exercises until they can reach a high resistance level. The door handle tool desirably improves wrench grip and capability with the mechanical torque advantage, and improves the ability of carrying items with a handle, opening and closing doors or cabinets, or using wrench-like items like hand tools.

Figure 18:
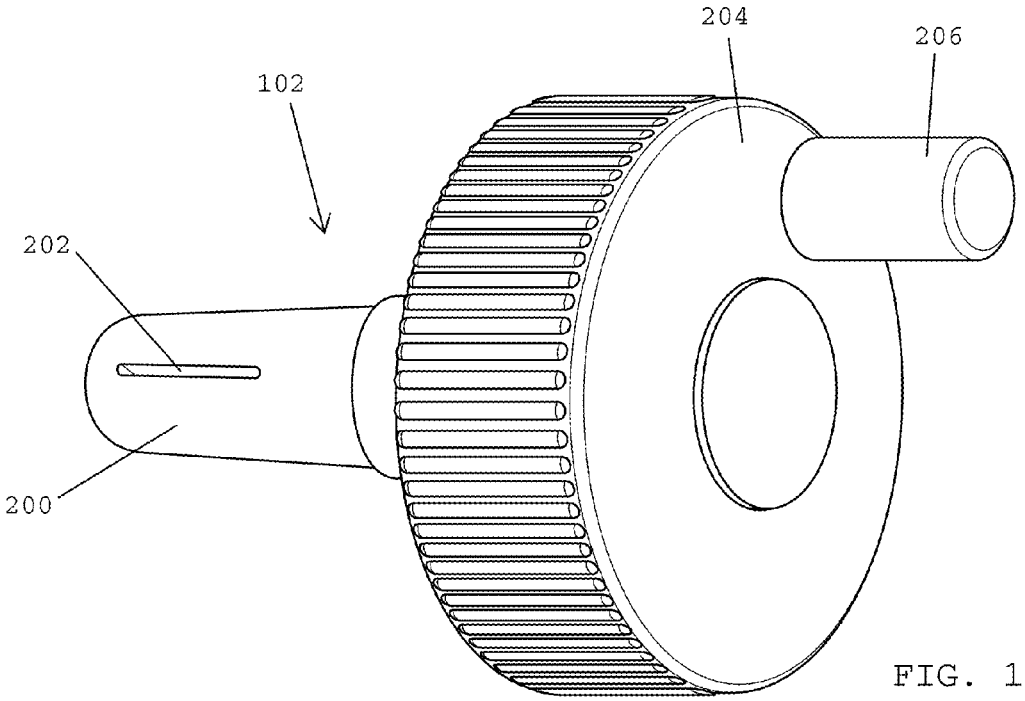
FIG. 18 shows a finger wheel tool with a pin, in accordance with one embodiment of the present invention.

Referring to FIG. 18, in one embodiment, a large finger wheel tool with pin 102 preferably includes an elongated shaft 200 that is insertable into a tool opening provided in a hand exercise housing. The elongated shaft 200 includes longitudinally extending slits 202 that enable the shaft to be compressed inwardly as resistance is increased. The large finger wheel tool with pin 102 also preferably includes a wheel 204 that may be grasped by an operator. A pin 206 desirably projects from a proximal face of the wheel handle 204. The large finger wheel tool 102, which desirably includes a knurled surface for turning the wheel 204, preferably enables a patient to exercise his or her finger distal grip, finger abduction and adduction in order to enable the patient to be able to regain his or her ability of picking up small objects like coins and then placing them in his or her palm, turning a paper clip, grabbing an object and turning it or stabilizing it like using or grabbing a pen or spoon. Additionally, the tool enables training of fine pincer grasp, which is necessary for writing.

Figure 19:
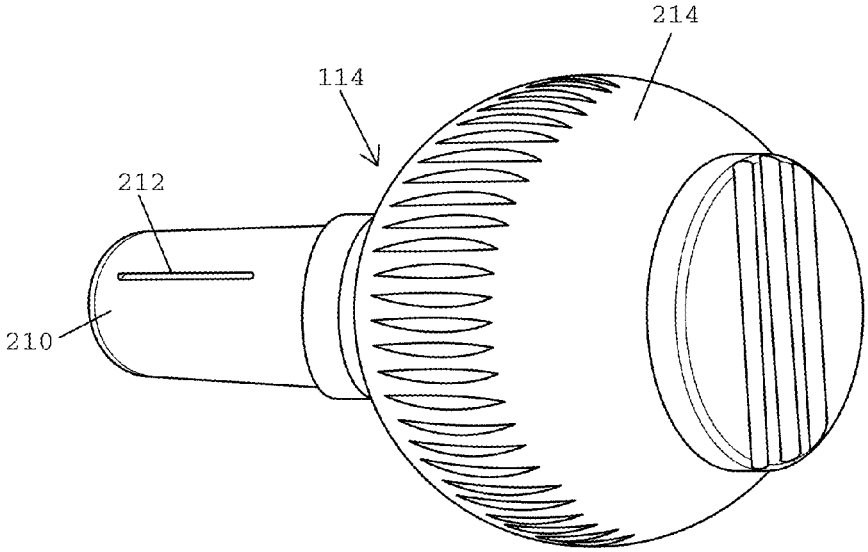
FIG. 19 shows a door knob tool, in accordance with one embodiment of the present invention.

Referring to FIG. 19, in one embodiment, a door knob tool 114 preferably includes an elongated shaft 210 insertable into a tool opening of the hand exercise housing. The elongated shaft 210 desirably includes one or more longitudinally extending slits 212 that enable the diameter of the shaft to be modified as the resistance level applied to the shaft 210 is modified. The door knob tool 114 preferably includes knob 214 secured to a proximal end of the elongated shaft 210. The knob 214 may be grasped by an operator for rotating the door knob tool 114 about the elongated shaft 210. The door knob tool 114 may be used to improve spherical grip combined with pronation and supination so as to provide for the ability to turn a door knob when opening and closing doors. The muscles that are activated by this tool may include the extensor carpi ulnaris, extensor carpi radialis, flexor digitorum profundus, flexor digitorum superficialis, interoseus, lumbricales, flexor pollicis longus, flexor pollicis brevis, extensor pollicis brevis, pronator teres, supinator and biceps, brachioradialis.

A smaller version of the door knob tool shown in FIG. 19 may be used. This smaller tool, referred to as a finger knob tool, is designed to improve pincer grasp, finger abduction, adduction and rotation and the ability to turn kitchen knobs. The muscles that may be activated using the finger knob tool desirably include opponent pollicis, extensor carpi ulnaris, extensor carpi radialis, flexor digitorum profundus, flexor digitorum superficialis, interoseus, lumbricales, flexor pollicis longus, flexor pollicis brevis, and extensor pollicis brevis.

Figure 20:
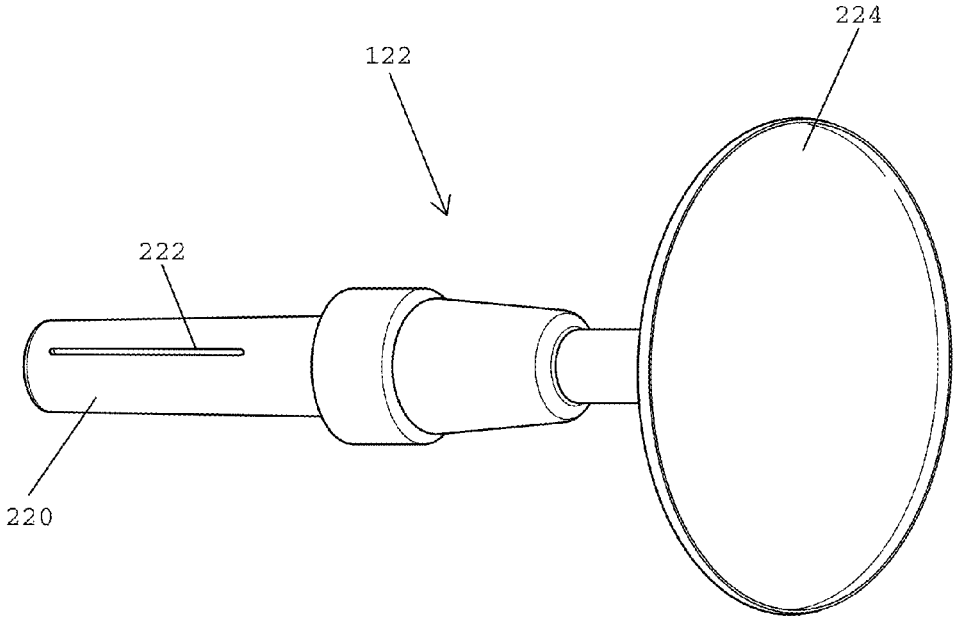
FIG. 20 shows a thumb screw tool, in accordance with one embodiment of the present invention.

Referring to FIG. 20, in one embodiment, a thumb screw tool 122 preferably includes an elongated shaft 220 insertable into a tool opening. The elongated shaft 220 desirably includes longitudinally extending slits 222 that enable the elongated shaft 220 to be compressible. The elongated shaft 220 is desirably insertable into one of the tool openings of the hand exercise housing. The thumb screw 122 preferably includes a disc shaped handle 224 secured to a proximal end of the elongated shaft 220. An operator may grasp the disc shaped handle 224 for rotating the tool 122 in either a counterclockwise or a clockwise direction during hand therapy exercises.

In one embodiment, the tools disclosed herein may be used in pairs to enable bilateral exercise using both hands simultaneously. Bilateral exercise will enable therapy that facilitates learning in neurological disorders where cognition is impaired. It has been shown that bilateral isokinematic training has achieved excellent results in neurological patients and helps reorganize cortical motor neuronal networks in a study by Mudie and Matyas, published in 2000.

The foregoing description of a preferred embodiment of the invention has been presented for purposes of illustration and description. It is not intended to be exhaustive or to limit the invention to the precise form disclosed. Obvious modifications or variations are possible in light of the above teachings with regards to the specific embodiments. The embodiment was chosen and described in order to best illustrate the principles of the invention and its practical applications to thereby enable one of ordinary skill in the art to best utilize the invention in various embodiments and with various modifications as are suited to the particular use contemplated.

What is claimed is:

1. A hand therapy system comprising:

a post having an upper end and a lower end;

a support base secured to the lower end of said post for supporting said post atop a surface;

a hand exercise housing mounted on said post for moving between the upper and lower ends of said post, said hand exercise housing including a plurality of first hand tool openings provided on a first side of said hand exercise housing, a plurality of second hand tool openings provided on a second side of said hand exercise housing, a progressive resistance system in communication with each of said first and second hand tool openings, a plurality of resistance level adjustment elements coupled with said progressive resistance system, each of said resistance level adjustment elements being associated with one of said first and second hand tool openings for selectively adjusting the resistance level of each of said first and second hand tool openings, wherein the first side of said hand exercise housing includes a first side plate including said first hand tool openings and the second side of said hand exercise housing includes a second side plate including said second hand tool openings, wherein said progressive resistance system comprises a plurality of size-adjustable openings, and wherein each of said size-adjustable openings is in communication with one of said first and second hand tool openings.

2. The hand therapy system as claimed in claim 1, wherein said hand exercise housing is adapted to slide between the upper and lower ends of said post for adjusting the height of said hand exercise housing on said post.

3. The hand therapy system as claimed in claim 2, further comprising at least one locking element coupled with said hand exercise housing that is adapted to engage said post for locking said hand exercise housing on said post.

4. The hand therapy system as claimed in claim 3, wherein said at least one locking element comprises a rotatable locking knob having a threaded shaft with a distal end adapted to contact said post for locking said hand exercise housing on said post.

5. The hand therapy system as claimed in claim 1, wherein each of said size-adjustable openings is in communication with one of said resistance level adjustment elements.

6. The hand therapy system as claimed in claim 5, wherein said resistance level adjustment elements are operable for changing the diameter of each of said size-adjustable openings.

7. The hand therapy system as claimed in claim 6, wherein said hand exercise housing includes resistance level indicia provided thereon and associated with each of said resistance level adjustment elements for enabling operators to select a resistance level.

8. The hand therapy system as claimed in claim 7, wherein said resistance level adjustment elements comprise rotatable knobs.

9. The hand therapy system as claimed in claim 6, further comprising a plurality of hand tools insertable into said first and second hand tool openings.

10. The hand therapy system as claimed in claim 9, wherein at least one of said hand tools comprises an elongated shaft insertable into one of said first and second tool openings and said size-adjustable opening associated therewith.

11. The hand therapy system as claimed in claim 10, wherein said elongated shaft has one or more longitudinally extending slots formed therein that facilitate radial compression of said elongated shaft.

12. The hand therapy system as claimed in claim 9, wherein said plurality of hand tools are selected from a group of tools consisting of finger wheels, finger wheels with pins, hand wheels, star knobs, door knobs, finger knobs, finger butterflies, thumb screws, door handles, eye bolts, and wrist bars.

13. The hand therapy system as claimed in claim 10, wherein upon insertion into one of said first and second hand tool openings, said at least one hand tool is rotatable about said elongated shaft.

14. The hand therapy system as claimed in claim 13, wherein at least one of said resistance level adjustment elements is operable for increasing the level of clamping force applied to said elongated shaft.

15. The hand therapy system as claimed in claim 1, wherein said hand exercise housing has a central opening extending from an upper end to a lower end thereof, and wherein said post passes through the central opening for mounting said hand exercise housing on said post.

16. The hand therapy system as claimed in claim 15, wherein said hand exercise housing comprises one or more flexible gaskets projecting into the central opening thereof for engaging said post so as to stabilize said hand exercise housing on said post.

17. The hand therapy system as claimed in claim 1, wherein said first hand tool openings are spaced apart from one another on the first side of said hand exercise housing at different vertical and horizontal positions, and said second hand tool openings are spaced apart from one another on the second side of said hand exercise housing at different vertical and horizontal positions.

18. The hand therapy system as claimed in claim 17, wherein a first rotatable hand tool is inserted into one of said first hand tool openings and a second rotatable hand tool is inserted into one of said second hand tool openings for enabling bilateral hand therapy.

19. A hand therapy system comprising:

a hand exercise housing;

a plurality of first hand tool openings provided on a first side of said hand exercise housing;

a plurality of second hand tool openings provided on a second side of said hand exercise housing;

a progressive resistance system in communication with each of said first and second hand tool openings;

a plurality of resistance level adjustment elements coupled with said progressive resistance system, each of said resistance level adjustment elements being associated with one of said first and second hand tool openings for selectively adjusting the resistance level of each of said first and second hand tool openings, wherein said progressive resistance system comprises a plurality of size-adjustable openings, and wherein each of said size-adjustable openings is in communication with one of said first and second hand tool openings.

20. The hand therapy system as claimed in claim 19, further comprising:

a post having an upper end and a lower end;

a support base secured to the lower end of said post for supporting said post atop a surface;

said hand exercise housing being mounted on said post above said support base, wherein the first side of said hand exercise housing includes a first side plate having said first hand tool openings and the second side of said hand exercise housing includes a second side plate having said second hand tool openings.

* * * * *